US007152738B2

(12) United States Patent
Pigott et al.

(10) Patent No.: US 7,152,738 B2
(45) Date of Patent: Dec. 26, 2006

(54) PALLETIZED TRAY SYSTEM

(75) Inventors: Maurice J. Pigott, Arlington Heights, IL (US); Brandon L. Pigott, Wilmette, IL (US); Schuyler F. Pigott, Arlington Heights, IL (US); Peter S. Pigott, Wilmette, IL (US); Jerry J. Fan, Vernon Hills, IL (US)

(73) Assignee: Orbis Corporation, Oconomowoc, WI (US)

( * ) Notice: Subject to any disclaimer, the term of this patent is extended or adjusted under 35 U.S.C. 154(b) by 359 days.

(21) Appl. No.: 10/616,763

(22) Filed: Jul. 10, 2003

(65) Prior Publication Data

US 2004/0026283 A1 Feb. 12, 2004

Related U.S. Application Data

(62) Division of application No. 10/034,408, filed on Dec. 27, 2001, now Pat. No. 6,874,637.

(51) Int. Cl.
*B65D 6/04* (2006.01)

(52) U.S. Cl. ..... 206/564; 206/511; 206/1.5

(58) Field of Classification Search ..... 206/509, 206/511, 512, 561, 564, 1.5; 220/509, 516, 220/517

See application file for complete search history.

(56) References Cited

U.S. PATENT DOCUMENTS

| | | | | |
|---|---|---|---|---|
| D149,519 | S * | 5/1948 | Reynolds | D3/311 |
| 4,445,614 | A | 5/1984 | Mitsumori et al. | |
| 4,454,946 | A | 6/1984 | Yokowo | |
| 4,765,252 | A | 8/1988 | Shuert | |
| 4,843,976 | A | 7/1989 | Pigott et al. | |
| 4,960,209 | A | 10/1990 | Tudor | |
| 4,976,353 | A | 12/1990 | Halliday | |
| 4,989,731 | A | 2/1991 | Shuert | |
| 5,060,819 | A * | 10/1991 | Apps | 220/519 |
| 5,409,110 | A | 4/1995 | Patent | |
| 5,415,286 | A | 5/1995 | Marchek et al. | |
| 5,415,289 | A | 5/1995 | Kim | |
| 5,441,154 | A | 8/1995 | Youell, III | |
| 5,579,686 | A | 12/1996 | Pigott et al. | |
| 5,660,279 | A * | 8/1997 | Apps et al. | 206/503 |
| 5,725,118 | A | 3/1998 | Slager et al. | |
| 5,827,966 | A * | 10/1998 | Lynch et al. | 73/488 |
| 6,032,801 | A | 3/2000 | Jupille et al. | |
| 6,237,758 | B1 * | 5/2001 | Hsu | 206/203 |
| 6,394,274 | B1 * | 5/2002 | Cheeseman | 206/511 |

(Continued)

FOREIGN PATENT DOCUMENTS

DE 38 19 624 A1 2/1990

(Continued)

OTHER PUBLICATIONS

Communications from the European Patent Office, transmitting a Partial European Search Report, mailed Sep. 30, 2004, for European Patent Application No. 02080559.4.

(Continued)

*Primary Examiner*—Shian T. Luong
(74) *Attorney, Agent, or Firm*—Schwartz Cooper Chartered

(57) ABSTRACT

A palletized tray system (10) is disclosed having a pallet (11) and a top piece (70) with a plurality of modular, stackable trays (40) disposed therebetween. The top piece (70) can be mated to a tray (40) or the pallet (11) positioned below the top piece (70); the pallet (11) can be mated to a tray (40) or the top piece (70) positioned above the pallet (11); and, each tray (40) may be mated with another tray (40), the pallet (11) or the top piece (70).

2 Claims, 6 Drawing Sheets

U.S. PATENT DOCUMENTS 6,604,675 B1 * 8/2003 Southwell ..... 229/164

FOREIGN PATENT DOCUMENTS

| | | |
|---|---|---|
| DE | 38 19624 A1 | 2/1990 |
| EP | 0 436 783 A1 | 7/1991 |
| FR | 1 167 061 | 11/1958 |
| FR | 1.167.061 | 11/1958 |
| FR | 2 371 349 | 6/1978 |
| FR | 2 371 349 A | 6/1978 |

OTHER PUBLICATIONS

Communication/European Search Report dated Dec. 22, 2004.

* cited by examiner

PALLETIZED TRAY SYSTEM

CROSS-REFERENCE TO RELATED APPLICATION

This application is a divisional of U.S. application Ser. No. 10/034,408 filed Dec. 27, 2001, now U.S. Pat. No. 6,874,637.

TECHNICAL FIELD

The present invention generally relates to pallets, and more particularly, to a tray system supported on a plastic pallet assembly.

BACKGROUND OF THE INVENTION

It is customary to transport goods and to store goods on pallets. Palletized goods are maintained in a position above the flooring. This is very advantageous in areas where there is flooding or where the condition of the flooring is either rough or of concern. Standard pallets are particularly useful in materials handling because forklift equipment can maneuver the pallets by inserting their forklift tines into channels provided by the pallet. Typically, pallets are constructed of wood. In the past, wooden pallets have provided advantages of economy, simplicity and durability, principally because of the lack of other suitable materials. However, wooden pallets are extremely heavy and costly.

In the past decades with the growth of the plastics industry, a wide variety of plastics have been investigated to determine their suitability for use in producing pallets. Plastic pallets can easily be manufactured and are more precise, uniform and cleaner than wooden pallets; also, the plastic used can be composed of recycled materials and can be recycled again. Furthermore, plastic pallets are more durable than wooden pallets. Plastic pallets light in weight, durable, capable of supporting heavy loads, easy to manufacture and have interchangeable parts are disclosed in: PLASTIC PALLET, U.S. Pat. No. 4,843,976, issued 4 Jul. 1989; PLASTIC PALLET, U.S. Pat. No. DES328,175, issued 21 Jul. 1992; PLASTIC PALLET WITH DECK ASSEMBLY, U.S. Pat. No. 5,197,395, issued 30 Mar. 1993; PLASTIC PALLET ASSEMBLY, U.S. Pat. No. 5,343,814, issued 6 Sep. 1994; TWO-PART INTERLOCKING PLASTIC PALLET, U.S. Pat. No. DES346,681, issued 3 May 1994; TWO PART INTERLOCKING PLASTIC PALLET ASSEMBLY, U.S. Pat. No. DES347,511, 31 May 1994; CONNECTOR FOR A PALLET ASSEMBLY, U.S. Pat. No. DES378,458, issued 11 Mar. 1997; CONNECTOR FOR A PALLET ASSEMBLY, U.S. Pat. No. DES354,606, issued 17 Jan. 1995; PLASTIC PALLET ASSEMBLY, U.S. Pat. No. DES364,030, issued 7 Nov. 1995; PLASTIC PALLET ASSEMBLY, U.S. Pat. No. 5,579,686, issued 3 Dec. 1996; CONNECTOR FOR A PALLET ASSEMBLY, U.S. Pat. No. DES378,458, issued 11 Mar. 1997; CONNECTOR FOR A PALLET ASSEMBLY, U.S. Pat. No. DES354,606, issued 17 Jan. 1995; PLASTIC PALLET ASSEMBLY, U.S. Pat. No. DES364,030, issued 7 Nov. 1995; PLASTIC PALLET ASSEMBLY, U.S. Pat. No. 5,579,686, issued 3 Dec. 1996; CONNECTOR FOR A PALLET ASSEMBLY, U.S. Pat. No. DES398,731, issued 22 Sep. 1998; CONNECTOR FOR A PALLET ASSEMBLY, U.S. Pat. No. DES412,047, issued 13 Jul. 1999; and, CONNECTOR ATTACHMENT FOR A PALLET ASSEMBLY, U.S. Pat. No. DES398,732, issued 22 Sep. 1998.

The pallets and connectors disclosed in these patents are owned by NUCON CORPORATION of Deerfield, Ill. USA and are highly successful.

While the present pallets support goods and transport goods well, problems develop when the goods are small and/or fragile. With such items, trays or bins need to be constructed on or separate from the pallets to permit the goods to be stacked upon the pallets. Such trays or bins have strong side walls to prevent the goods from falling and/or crushing the goods below them. With respect to trays, they are often incompatible with the pallet or less than optimum.

In addition, with automation increasing daily, pallets are now automatically loaded, moved, stored, transported and unloaded. As a result, the orientation of the goods on the pallet may become important to the proper execution of an automatic loading and unloading sequence.

The present system was designed to integrate a pallet with one or more stacked trays and cover to maximize the surface area of the pallet, utilize the strength of the pallet, ensure proper orientation of the goods on the pallet, provide a protective cover for the trays and permit the stacking of trays without jeopardizing cleanness, safety and strength.

SUMMARY OF THE INVENTION

A modular pallet system is disclosed having three primary components, that being a pallet, one or more trays, and a top piece. The pallet is designed to support one or more trays thereon or a top piece directly thereon. Each tray is designed to mate with either another tray above or below it, the pallet below it or the top piece above it. And, the top frame is designed to mate with a pallet or tray below it and a top piece or tray above it.

In this manner, the pallet can be transported empty with just a top piece above it. Or, the pallet can be used to support one or more trays stacked upon it. The top piece would then be mated with the top tray. In addition, for storing multiple assemblies, a pallet can be secured on top of a top piece.

The pallet has a base and deck and channel means for accepting forklift tines or similar lifting devices therein between. Each tray is configured to mate with either a pallet or a tray beneath it and either a tray or a top piece above it. The top piece and pallet can also mate with one another. Thus, one can put upon the deck of a pallet a single tray or a plurality of trays and a top piece or a top piece alone.

The trays are modular in nature. There are means on the bottom of the tray for cooperating with either the deck of the pallet or another tray. The means is a series of indentations formed in the sides of the tray. Means on the top of the tray for cooperating with either another tray or the top piece is a series of posts formed in the sides of the tray. Posts also project upwardly from the pallet and indentations are formed in the bottom of top piece. These posts and indentations cooperate and interlock with one another when the top frame, trays and pallet are properly aligned. A series of posts and indentations are formed in each of the components (pallet, trays and top piece) that are offset to ensure proper alignment. In particular, the posts and indentations on one half of the component (tray, top piece or pallet)(the median being between the ends) are spaced from the median a different distance than the posts and indentations on the other half of the component (tray, top piece or pallet) such that when one component is stacked upon another component, the post of the one component will align and cooperate with the indentation of the other component only when the front ends and back ends of the two components are aligned one above the other and coplanar.

Each tray, the pallet and the top piece have other contact points or surfaces in addition to the posts and the indentations just noted so that a vertical load is transmitted through these contact points or surfaces from the top piece to each tray thereinbelow and to the pallet in a more uniformly distributed manner when a tray is stacked upon the pallet or a plurality of trays is stacked upon the pallet and the top piece is stacked upon a top tray.

The pallet footprint, defined by its outer perimeter dimensions is the same for the top piece and trays.

Each post and each indentation is ideally trapezoidal in shape for easy seating and mating.

The trays further have a plurality of parallel channels formed in the top surface thereof for storing goods therein. Each channel is separated by a longitudinal wall. At least two of the longitudinal walls are higher than other walls for abutting the bottom surface of another tray or a top piece stacked thereon. Each tray further includes a stop formed at an end of a channel at an end of the tray for preventing goods stored in the channel from being moved out of the tray at the end with the stop. In this manner the tray can be tilted without goods being spilled out. In addition, this facilitates loading and unloading by automated mechanical means. A first end and an opposed second end of the tray further overhang respectively upon the first end and an opposed second end of a tray placed underneath to block the goods from sliding out of the channels in the tray placed underneath while the tray is being moved or maneuvered.

Each tray also includes a plurality of parallel transverse ribs formed in the bottom surface thereof. The transverse ribs formed in the bottom surface thereof are designed to be in direct contact with top surfaces of longitudinal walls formed in a tray placed underneath the tray when the trays are mated. In addition, the trays have at least one pocket on each side serving as the lifting points for stacking and de-stacking.

In addition to the mating means associated with it, the top piece further includes a plurality of ribs on the under side for contacting the top surfaces of longitudinal walls on a tray coupled underneath the top piece while the indentations or posts on the top piece engage posts or indentations on the tray coupled underneath. The top piece further comprises a first end and an opposed second end overhanging a first end and an opposed second end of a tray coupled underneath to block any goods from sliding out of channels carried in the tray underneath. The top piece further includes projections raised from a top surface thereof to align with openings formed in the base of the pallet to prevent sliding between the pallet and top piece when the pallet is placed on top of the top piece during warehousing.

These and other aspects of the present invention set forth in the appended claims may be realized in accordance with the following disclosure with particular reference to the accompanying drawings.

BRIEF DESCRIPTION OF THE DRAWINGS

In the accompanying drawings forming part of the specification, and in which like numerals are employed to designate like parts throughout the same.

DETAILED DESCRIPTION

Figure 1:
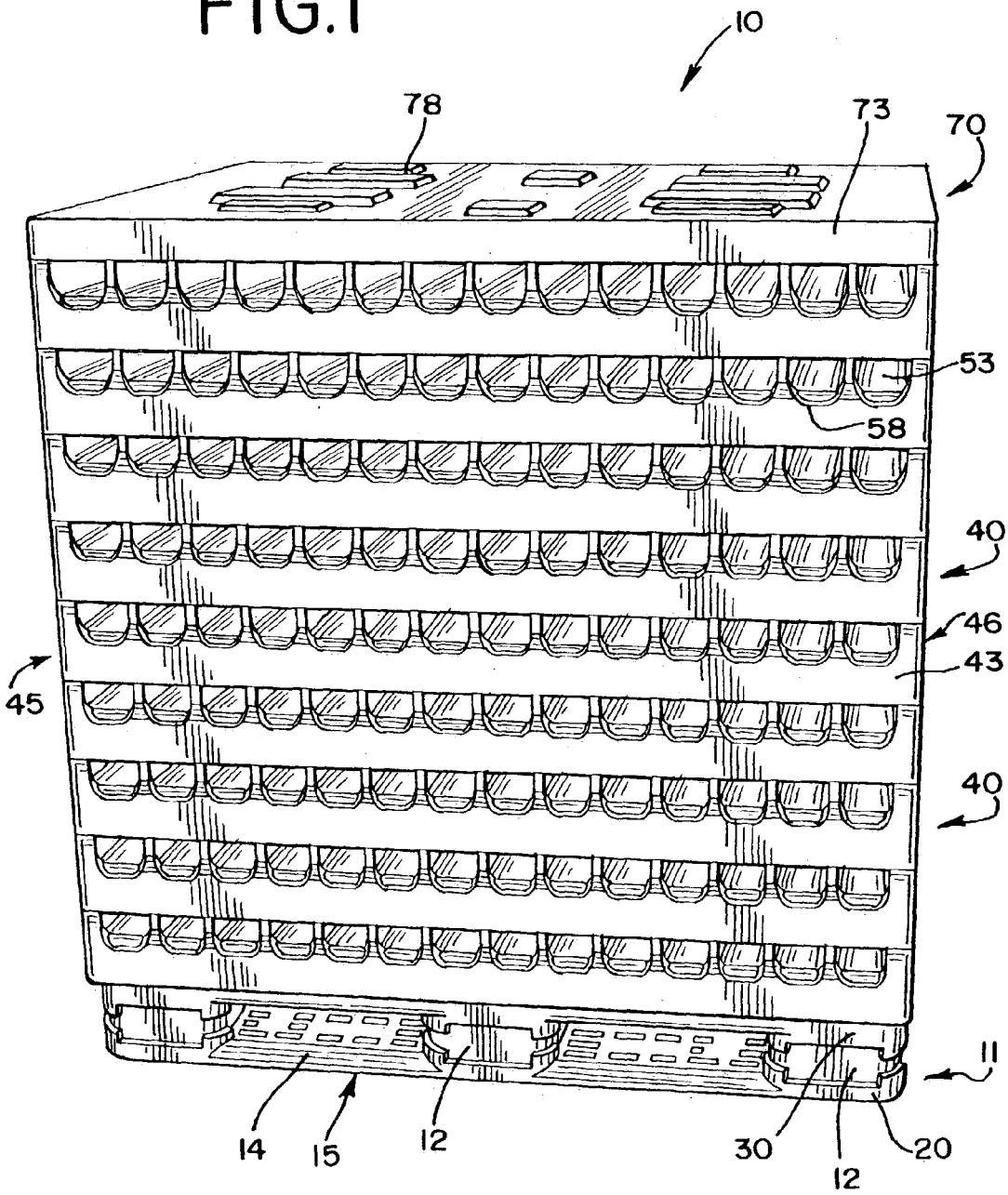
FIG. 1 is a perspective view of the palletized tray system made in accordance with the teachings of the present invention.

While this invention is susceptible of embodiments in many different forms, there is shown in the drawings and will herein be described in detail preferred embodiments of the invention with the understanding the present disclosure is to be considered as an exemplification of the principles of the invention and is not intended to limit the broad aspect of the invention to the embodiments illustrated.

Turning to the FIG. 1, the assembly or system 10 is shown as including three primary components, that being a pallet 11, a plurality of trays 40 and a top piece 70. The pallet 11 includes a base 20, a plurality of connectors 12 and a deck 30. The general construction of the pallet is disclosed in U.S. Pat. No. 5,579,686, titled PLASTIC PALLET ASSEMBLY, issued 3 Dec. 1996 and incorporated herein by reference. The connectors are further disclosed in U.S. Pat. No. 4,843,976, titled PLASTIC PALLET and incorporated herein by reference.

The connectors 12, interconnecting the deck 30 and base 20, are specially designed so the pallet 11 can be assembled without the need for specially designed tools, and the connectors can be snap-fitted onto the deck and base. Both the deck and the base have openings which define surrounding abutments recessed below the exposed surface and the connectors (separate and integral) have flexible tangs with barbs which engage the abutments. The pallet 11 has opposed sides 13 and opposed ends 14 (front end is designated 15). The connectors 12 are positioned so forklift tines can be inserted into channels 16 formed between the connectors in the sides 13 and ends 14 of the pallet 11 for lifting and moving the assembled pallet and the palletized trays and goods.

Figure 3:
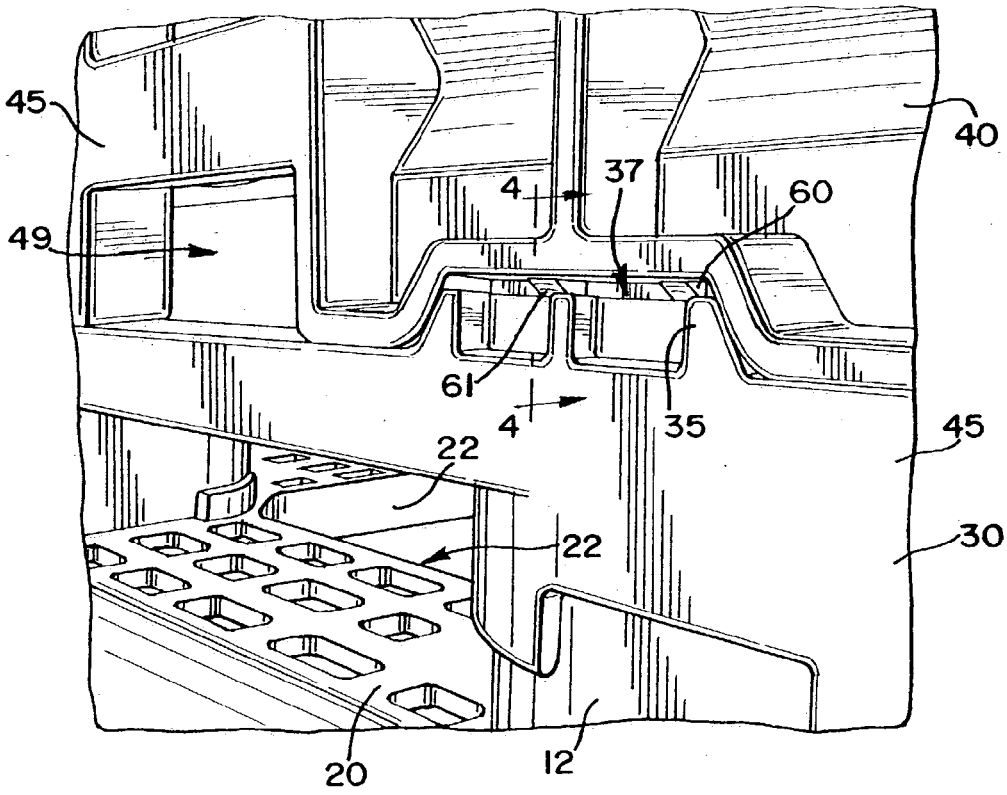
FIG. 3 is a detail of the mating between two sections, the pallet and tray.
Figure 4:
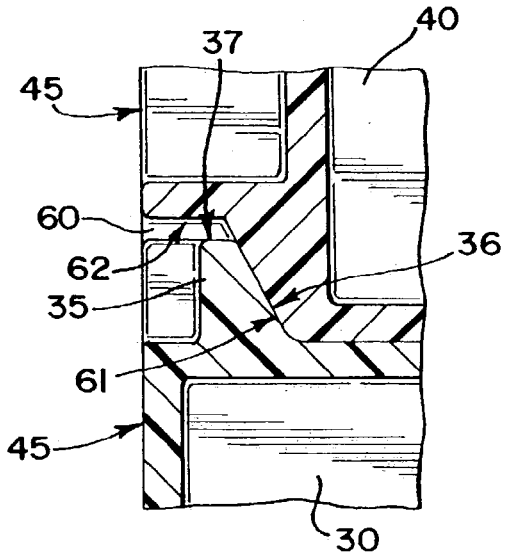
FIG. 4 is a sectional view along line 4—4 in FIG. 3.

The base 20 of the pallet 11 generally rests on the ground or floor and is rectangularly shaped and is composed of frame members 22 (FIG. 3). The base 20 supports the deck 30 above the flooring. The base has two surfaces, namely an inner surface and an outer surface. The outer surface is the surface that faces out from the pallet, the surface facing down and contacting the ground or floor when the pallet is constructed. The inner surface of the base is the surface facing the inside of the pallet, i.e., the surface the connectors are attached to and the surface facing the deck.

The deck 30 is generally rectangular in shape. The outer surface (upper surface) 31 of the deck 30 is substantially planar and the inner surface (bottom surface—not shown) has a reinforcement structure projecting outwardly therefrom. This reinforcement structure includes a plurality of cells formed by a plurality of parallel end walls and a plurality of side walls. The cells are substantially rectangular and are approximately the same size. There are a plurality of reinforced openings 32 in the deck 30 for seating and cooperating with the tangs of the connectors 12.

To assemble the pallet 11, the connectors 12 are first assembled to a first piece, either the base 20 or the deck 30, by aligning a set of connector tangs with an opening in the base and deck and then applying an axial force which causes the barbs to deflect the tangs inwardly sufficient to allow the set of tangs to pass through the openings. After the barb has cleared the abutment surface, the memory characteristics of the plastic will snap the tangs back to their original condition and lock the connector to the base or deck. After all the connectors are assembled on the base or deck, the other piece, i.e., deck or base, is positioned above or below the piece with the connectors and the openings therein are aligned. A force applied to the outer surface of the second piece will similarly snap the connectors to the second piece. Removal of connectors or the separation of components can be accomplished very easily with the aid of a simple tool, such as the one shown and claimed in U.S. Pat. No. 4,843,976.

The present system is modular and can be customized for multitudes of purposes. Conceptually, a plurality of trays or bins are stacked and cooperate with one another; this assembly of trays or bins is sandwiched between a pallet and a top piece. The system (pallet-trays/bins-top piece) can be stacked upon each other. The bottommost tray or bin cooperates with the upper surface of the pallet and the uppermost tray or bin cooperates with the bottom or under surface of the top piece. Being modular, the top piece can be removed and the trays or bins can de-stacked from the pallet and used in a process. This can easily be accomplished automatically. For compressed transport, the pallet also cooperates and mates with the top piece. Accordingly, just the pallet and mated top piece can be transported or stored.

Figure 2:
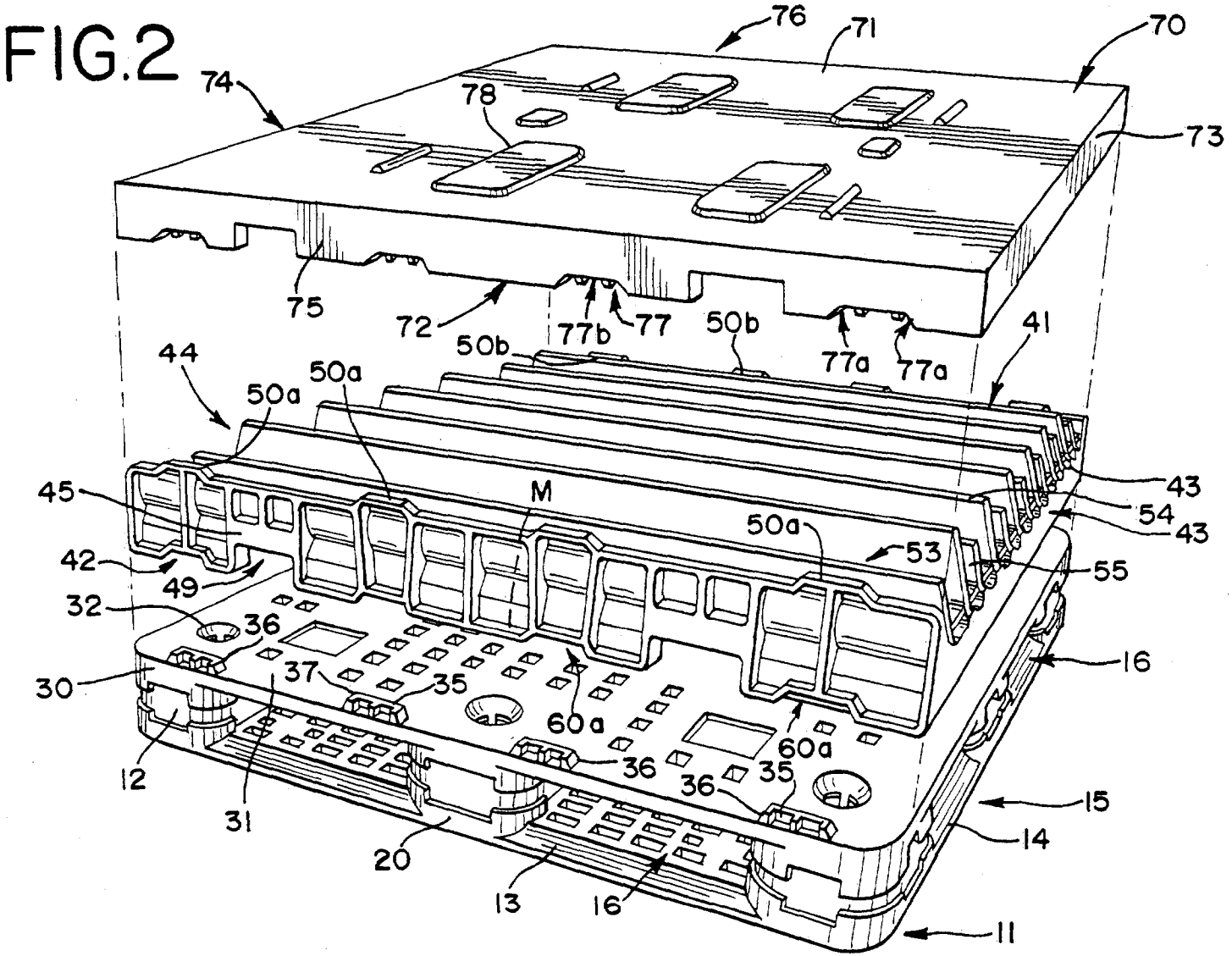
FIG. 2 is an exploded side elevation view of the system shown in FIG. 1.

The pallet 11 is particularly designed to mate with and support a tray 40 immediately thereon and each tray 40 is designed to mate with and support either another tray 40 thereon or a top piece 70 thereon. In short, a tray 40 can mate with the pallet 11 or another tray 40 below and support a further tray 40 or a top piece 70 above. A plurality of trays 40 may be stacked and mated with one another between the pallet 11 and the top piece 70. For example, FIG. 1 shows nine (9) trays 40 disposed between the pallet 11 and top piece 70 and FIG. 2 shows only one tray 40 between the pallet and the top piece.

Figure 6:
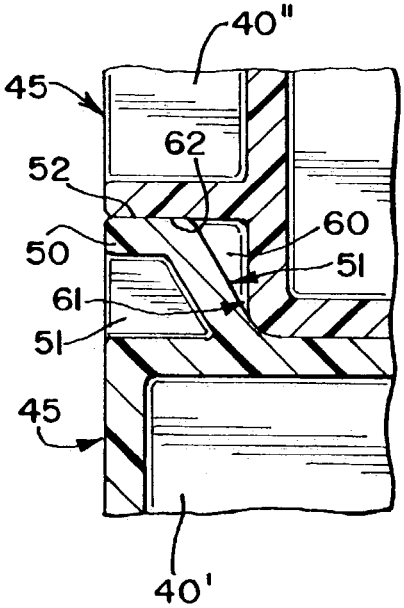
FIG. 6 is a sectional view along line 6—6 in FIG. 5.

Turning to the construction of the tray 40, it has a top surface 41, a bottom surface 42, a first or front end 43, an opposed second or rear end 44, a first side 45 and an opposed second side 46. The tray is generally rectangular in shape. The ends 43,44 and sides 45,46 are walls/surfaces. There are a plurality of posts 50 projecting upwardly and outwardly from the top of each of the side walls 45,46 of the tray 40 and a plurality of indentations 60 projecting upwardly and inwardly from the bottom of each of the side walls 45,46. FIG. 2 shows four (4) such posts 50 and four (4) such indentations 60 on one side wall 45. The side posts 50 of a first tray 40 mate with the side indentations 60 of a second tray 40 stacked upon the first tray to maintain the trays in a stacked position and to prevent the trays from sliding or slipping relative to one another. In addition, the posts and indentations are configured to promote easy stacking and de-stacking and are arranged to promote proper alignment and prevent misalignment. Each post 50 or indentation 60 is generally trapezoidal in shape, having inclined side walls (on 3 sides) 51,61 and a substantially flat abutting wall/surface 52,62. This construction permits the easy registration or indexing of the posts with the indentations. This is because the opening at the bottom of an indentation is substantially bigger than the top area of a post to allow for tolerance in alignment of each tray and each post will slide into each indentation on angled surfaces for proper coupling. Once engaged, the gaps between the contacting surfaces become relatively small so the stack of multiple trays is maintained in tight position tolerances. This is important especially for automated handling equipment that stacks and de-stacks the trays. FIG. 6 shows a section view of a post 50 from a first tray 40' mating with an indentation from a second tray 40".

One important aspect of the present invention is to ensure that the trays stacked upon one another are oriented correctly and similarly. Discussed in more detail below, the front end 43 includes a wall or stop 58 (FIG. 5) to prevent the items supported in the channels from sliding out of the front end. It is important for the front ends 43 of stacked trays to align, one on top of another. To accomplish this, the posts 50 and indentations 60 are configured so that the posts 50 of a lower tray 40' will align with the indentations 60 of an upper tray 40" only if the front ends 43 of the trays are aligned one on top of the other. If a tray is placed on another tray with the back end of the upper tray over the front end of the lower tray, the posts and indentations will not mate and the upper tray will be unable to mate or seat with the lower tray. The upper tray will need to be rotated 180° for proper alignment.

Figure 8:
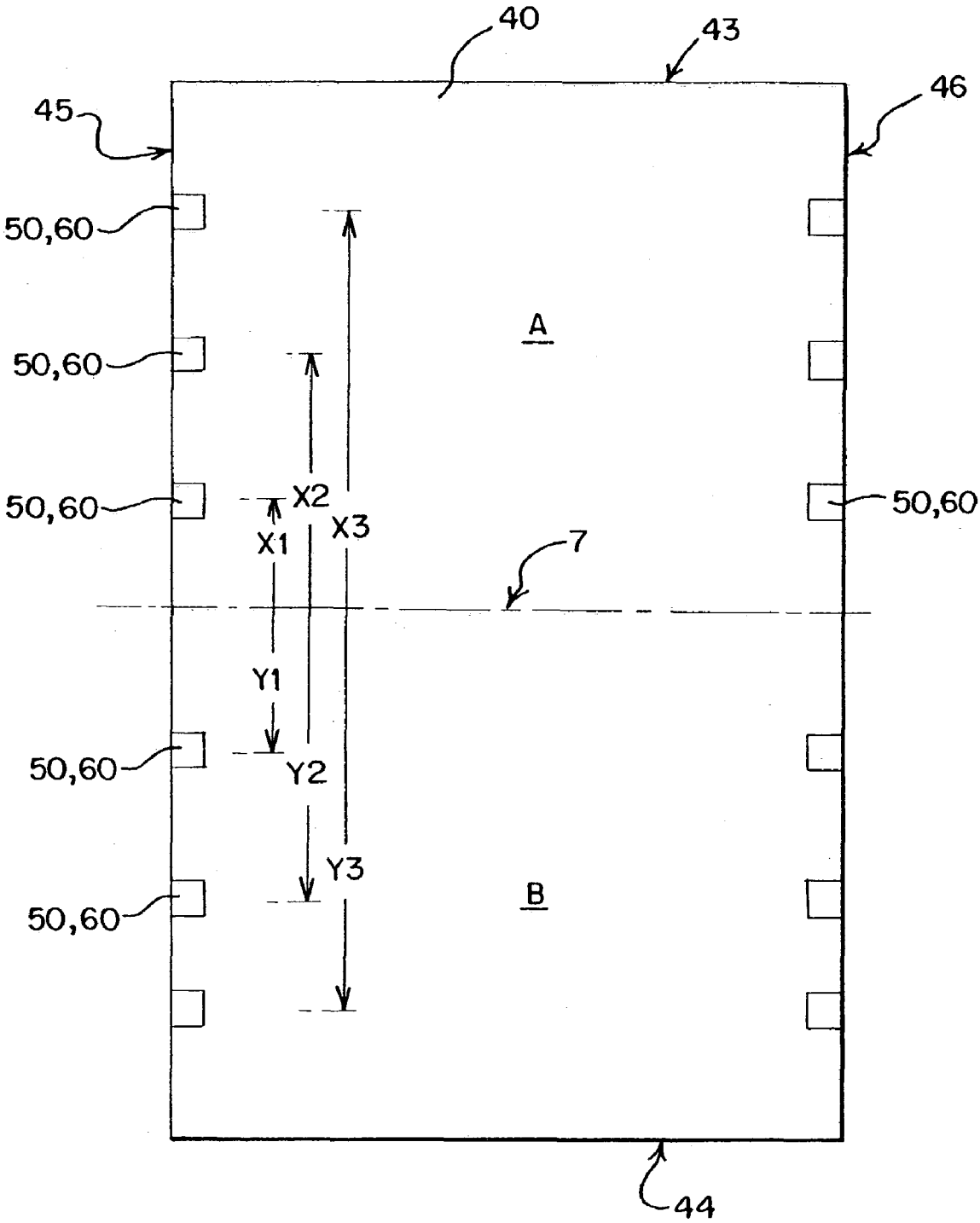
FIG. 8 is a schematic representation of the top plan view of a pallet, tray and top piece showing the post/indentation configuration and alignment.

There are multiple ways of ensuring alignment. One such method is shown in FIG. 8. A median (line M in FIGS. 2 and 8) is the centerline between the two ends 43,44 forming two half portions (half portion A and half portion B), each such half portion being between an end and median. The parallel posts 50 and parallel indentations 60 on one half of the tray 40 (portion A) are spaced a different distance from the median or centerline of the tray (M) than the posts and indentations 50,60 on the other half of the tray (portion B). In short, the distances between the median M and the parallel posts/indentations 50,60—X1, X2, X3—of one half the tray A are different than the distances between the median M and the parallel posts/indentations 50,60—Y1, Y2, Y3—of the other half of the tray B. Thus, the distance X1 is different than the distance Y1.

When a second tray is stacked upon a first tray, the posts of the first tray will align and cooperate with the indentations of the second tray only when the first end, e.g., front end 43, of the second tray and the first end, e.g., front end 43, of the first tray are aligned one above the other and coplanar. In this manner, the front surfaces of the trays will always be stacked facing one direction. As noted, one is unable to stack a tray upon another tray where the back surface 44 or a side surface of one tray is above and aligned with the front surface of the other tray.

This is important because in many applications the orientation of a tray is important, such as in automation. In many automated processes, goods are put on a carrier, such as a tray, with a particular orientation, here in a certain direction, next transported or stored and eventually unloaded to be worked upon. It is frequently important for the orientation of the loaded goods to correspond with the orientation of the unloaded goods. For example, if goods are automatically loaded from a molding station so that they face the front of the tray and pallet, it may be crucial that they be automatically unloaded to a filling and sealing station facing the front of the pallet and trays. Having goods oriented one way on one tray and another way on another tray, can disrupt the automation process, possibly requiring human intervention as each tray is unloaded.

While the above discussion is to trays 40, the posts 35 on the top surface 31 of the deck 30 of the pallet 11 can be similarly configured, as well as the indentations 77 in the side surfaces 75,76 of the top piece 70, to ensure proper alignment of the pallet 11 under the trays or top piece and the top piece above the trays or pallet.

Each tray has a plurality of parallel channels 53 formed in the top surface 41 thereof. While channels are shown in the figures, other configurations can be easily employed depending upon the goods W being palletized. Here, the goods palletized are empty, molded plastic bowls W used to store single servings of food items. The automatic loading and unloading equipment systematically works with the rows or columns of nestled bowls W. It is recognized that the width and depth of the channels can be easily modified.

Longitudinal walls 54,55 of differing heights separate each channel 53. As shown in FIG. 2, some longitudinal walls 54 (here, every other wall) are higher than the adjacent walls 55. This reduces the amount of material used in constructing the tray and reduces the weight of the tray. The lower longitudinal walls 55 are high enough to prevent product W from moving within a channel or migrating from one channel to another channel. The higher longitudinal walls 54 abut the bottom surface 42 of the tray 40, or top piece 70, stacked above it.

Pockets 49 are constructed in the side walls 45,46 of the trays 40 so that equipment or a human hand may extend into and under the tray, pick it up, move it and be removed from the underside of the tray.

To further prevent goods from being moved out of the channels in a wrong direction, when there is no other tray or a top piece placed on the top of the tray, a wall or stop 58 (FIG. 5) is formed at the front end 43 along the bottom the channels 53 of the tray 40. If necessary, a second wall may be formed at the other end 44 of the channel 53. In the embodiment shown, a lower wall 58 is constructed at one end of the channels only because the goods are automatically slid in and out of the channels 53 at the other end. A wall at the other end would prevent such mechanical loading and unloading.

The purpose of the wall or stop 58 being lower than the actual goods carried in the channels is to expose the goods from that end so an automated discharging mechanism can reach in to push the goods through the channel and out the other, opposed end of the channel.

Figure 5:
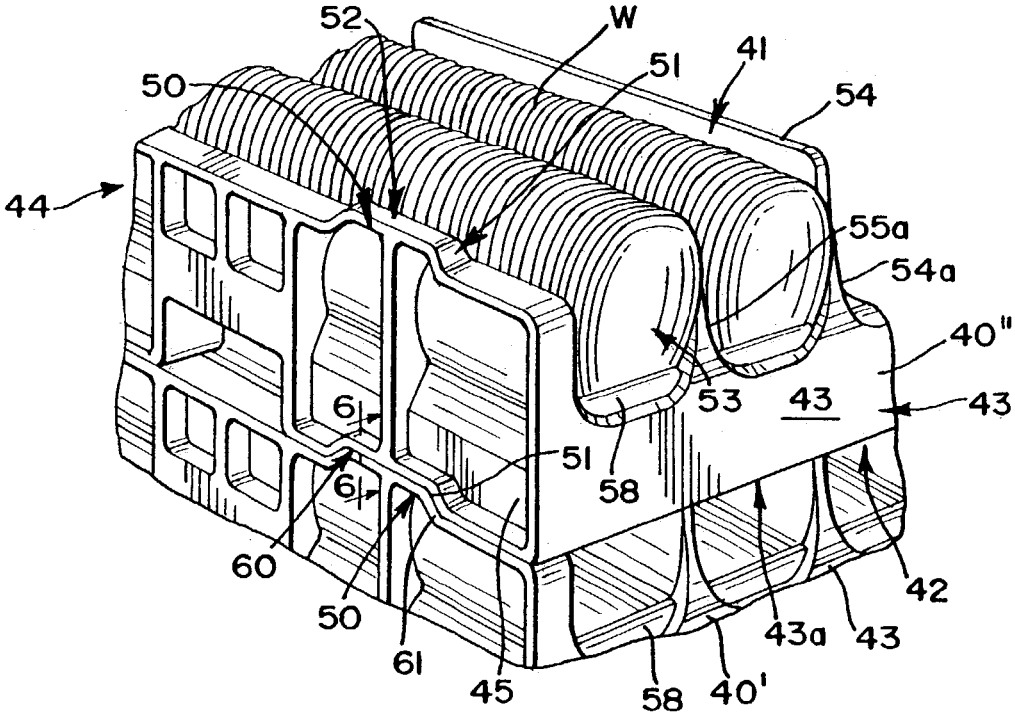
FIG. 5 is perspective partial view of a tray with goods on it.

The front surface 43 and rear or back surface 44 of the trays 40 are designed to overhang the channels 53 in the tray immediately below the tray (see overhang 43*a* in FIG. 5). As shown in FIG. 5, the walls 54,55 between the channels 53 in the trays 40 have inclined lead surfaces 54*a*,55*a* at the front end 43 and rear end 44. This permits the front and rear walls 43,44 of the tray 40 to overhang the two ends of the channels and act as an upper stop or bumper at both ends of the channel on the tray just below this tray when multiple trays are stacked (see FIG. 5). As noted previously, a stop 58 formed at the front end 43 along the bottom of the channels 53 of the tray 40 also prevents sliding of the items W from the front of the tray. Thus, while a first tray 40 is in place above a second tray 40, the items W stored in the channels 53 of that second tray cannot fall out from the ends of the channels. Once the first tray is removed, the items W in the second tray may be slid out the end of the channel without the stop 58 such as by tipping the entire tray or by pushing action at the front end of the tray by an automated mechanism.

It is, of course, recognized by those skilled in material handling that hinged gates and other mechanisms can be employed to facilitate the loading and unloading of goods and the preventing of goods from falling from the tray during loading, unloading, transporting and storing.

For added support, the tray 40 has a plurality of parallel transverse ribs 48 (FIGS. 9 and 10) formed in the bottom surface 42 thereof running perpendicular to the channels 53. When the trays are stacked on top of each other, the bottom surfaces 48*a* of these transverse ribs 48 are in direct contact with the top surfaces of the higher longitudinal walls 54 from the trays underneath. With this configuration, the load of trays and the loads in the trays are transmitted through the longitudinal walls to the transverse ribs to the pallet at the bottom of the system and ultimately to the floor or a supporting surface underneath the pallet. This is important because this design enables a more uniform distribution and transmitting of the vertical loads of the system. The individual trays can therefore be constructed with less material and strength requirement.

Further, the addition of the ribs 48 enables one to make the trays with less stiff material, such as commodity plastics, to a size having the same footprint as the pallet, which can be fairly large, e.g., 40"×48", 36"×48", 1000 mm×1200 mm, 800 mm×1200 mm, etc. Because of these fairly large spans, stiffness is an important characteristic. In the field, because of this stiffness requirement, trays made of plastic and placed on pallets are usually smaller than the full size pallet. When the trays are large in size, they usually depend on the products they carry to help support the load. For instance, metal products carried on trays often support and transmit the load themselves. The trays are thus used as dividers of layers. Contrarily, the present design uses the trays to both support and to transmit the loads while protecting fragile or soft items carried by/within them.

Figure 9:
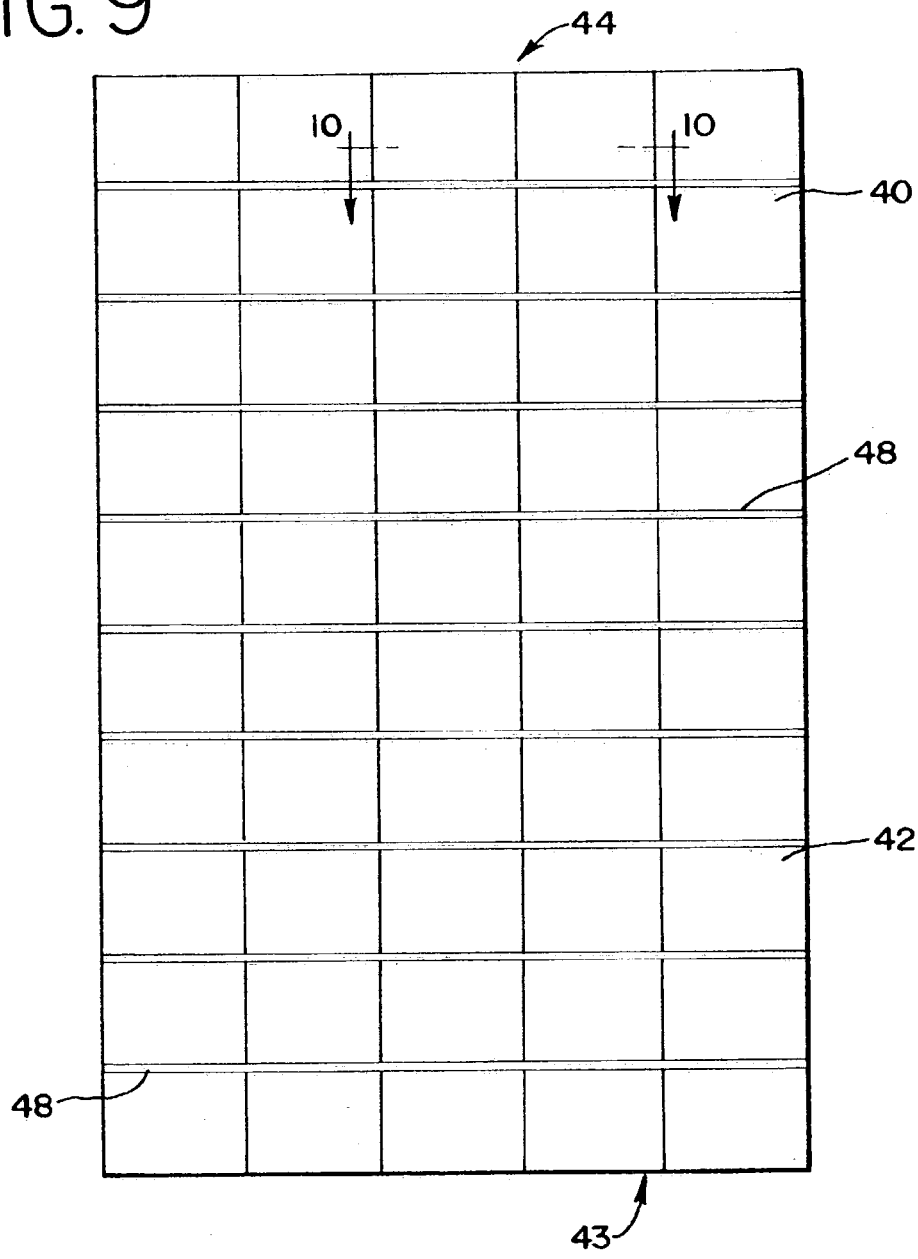
FIG. 9 is a schematic bottom plan view of a tray showing the transverse ribs; and, FIG. 10 is a sectional view along line 10—10 in FIG. 9.
Figure 10:
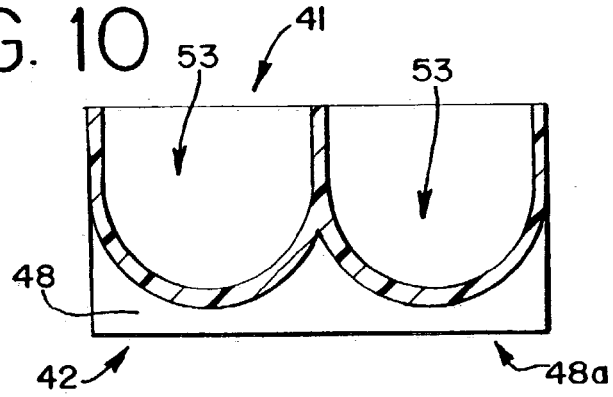

It should be noted that while FIG. 9 and FIG. 10 show continuous transverse ribs 48 spanning the width of the tray 40, other configurations, such as short, collinear ribs or pillars can be used to strengthen the trays and act as contact points for transmitting the forces applied to the tray.

The top piece 70 (FIG. 2) also has a top surface 71, bottom surface 72, opposed end surfaces (walls) 73,74 and opposed side surfaces (walls) 75,76. The side walls 75,76 and underside of the side walls of the top piece are constructed like the underside and side walls of the trays such that the bottom of the side walls of the top piece cooperates with the top of the side walls of the tray. In particular, the top piece employs indentations 77 in the sides 75,76 thereof for cooperating with the posts 50 of the tray 40. These indentations 77 permit the top piece 70 to mate with and nest over a tray 40. When the top piece 70 is stacked upon a tray 40, the posts 50 of the tray will align and cooperate with the indentations 77 of the top piece only when the first end, e.g., front end 43, of the tray and the first end, e.g., front end 73, of the top piece are aligned one above the other and coplanar. In this manner, the front surfaces of the trays and top piece will always be stacked facing one direction. One is unable to stack the top piece upon a tray where the back surface 44,74 or a side surface of the tray is below and aligned under the front surface of the top piece. It should be further noted that the indentations 77 are configured to promote easy stacking and de-stacking and are arranged to promote proper alignment and prevent misalignment of the top piece. Each indentation 77 is trapezoidal in shape, having inclined side walls (on 3 sides) 77*a* and a substantially flat abutting wall/surface 77*b*. This construction permits the easy registration or indexing of the posts of the tray (or pallet) with the indentations. This is because the opening at the bottom of an indentation is substantially bigger than the top area of a post to allow for tolerance in alignment of the top piece over the tray and each indentation will slide into each post on angled surfaces for proper coupling. Once the trays, tray and pallet, or tray and top piece are engaged, the gaps between the contacting adjoining surfaces become very small so the stack of multiple trays and the top piece is maintained, with relatively tight tolerances.

The front surface 73 and rear or back surface 74 of the top piece 70 are also designed to overhang the channels 53 in the trays 40. The inclined lead surfaces 54*a*,55*a* of the channel walls 54,55 between the channels 53 at the front end 43 and rear end 44 of the trays 40 permit the front and rear walls 73,74 of the top piece 70 to overhang the two ends of the channels and act as an upper stop or bumper at the ends of the channels. Thus, while the top piece 70 is in place above a tray 40, the items W stored in the channels 53 cannot fall from the ends of the channels. Once the top piece is removed, the items W may be slid out the end of the channel without the stop 58.

For added support, there are also a plurality of transverse ribs on the underside of the top piece. Such transverse ribs are shown in conjunction with the tray 40 in FIGS. 9 and 10. The ribs for the top frame are configured in the same manner. The bottom surfaces of these transverse top piece ribs are in direct contact to the top surfaces of the longitudinal walls 54 of the tray placed underneath the top piece (similar to the bottom surfaces 48*a* of these transverse ribs 48 of the tray 40 being in direct contact with the top surfaces of the higher longitudinal walls 54 from the trays underneath). Again, this construction transmits the load (weight) through the ribs on the underside of the top piece, to the longitudinal walls and the transverse ribs of each tray, to the pallet at the bottom of the unit or system, and ultimately to the floor or a supporting surface underneath the pallet in a more uniform and distributed manner. Again, this design enables a more uniform distribution and transmitting of the vertical loads of the system. The top pieces can therefore be constructed with less material and strength requirement.

The top surface 71 of the top piece is substantially planar or flat except for contoured ridges 78. These ridges 78 are constructed in the top surface 71 of the top piece 70 to align with openings formed between the frame members 22 of the base 20 of the pallet 11. Thus, a pallet 11 can be fittingly stacked upon the top piece 70. Multiple layers of the present system (pallet, multiple trays and top piece) can thus be stored on top of one another. Without the top piece, one cannot stack a pallet directly onto the top of a tray because there is no favorable way to couple the bottom of the pallet with the top of a tray. The top piece also shields the tray underneath from the dirt or other foreign objects.

As noted, the pallet 11 includes a base 20, a plurality of connectors 12 and a deck 30. The base 20 can be stacked upon a top piece 70, the ground or shelves. The upper or top surface 31 of the deck 20 is constructed like the upperside and side walls of the trays such that the bottom of a tray 70 cooperates with the top of the pallet 11. In particular, the deck 30 employs posts 35 in the top surface 31 adjacent the sides 13 thereof for cooperating with the indentations 60 of the tray 40. The posts 35 are configured to promote easy stacking and de-stacking and are arranged to promote proper alignment and prevent misalignment. Each post 35 is trapezoidal in shape, having inclined side walls (on 3 sides) 36 and a substantially flat abutting wall/surface 37. This construction permits the easy registration or indexing of the posts with the indentations 60 of the tray (or 77 of the top piece 70) because each post will slide into each indentation for proper coupling.

These posts 35 permit the pallet 11 to mate with, support and nest under a tray 40. When a tray 40 is stacked upon the pallet 11, the posts 35 of the pallet will align and cooperate with the indentations 60 of the tray only when the first end, e.g., front end 43, of the tray and the first end, e.g., front end 15, of the pallet are aligned one above the other and coplanar. In this manner, the front surfaces of the trays and pallet will always be stacked facing one direction. One is unable to stack a tray upon the pallet where the back surface or a side surface of the tray is below and aligned under the front surface of the pallet.

In another embodiment, not shown, there are a plurality of parallel longitudinal ribs 38 (see FIG. 7) on the top surface 31 on the deck 30. When a tray 40 is placed on the top of the pallet 30, the top surface of these longitudinal ribs 38 will be in direct contact with the bottom surfaces and the transverse ribs 48,48*a* (FIGS. 9 and 10) on the under side of the tray. Likewise, the deck's ribs will be in direct contact with the ribs on the under side of a top piece when it is placed directly on the top of the pallet. Again, this enables the load to be transmitted through the top piece, the multiple trays, to these longitudinal ribs on the pallet at the bottom of the unit and ultimately to the floor or a supporting surface underneath the pallet in a more uniform and distributed manner.

Figure 7:
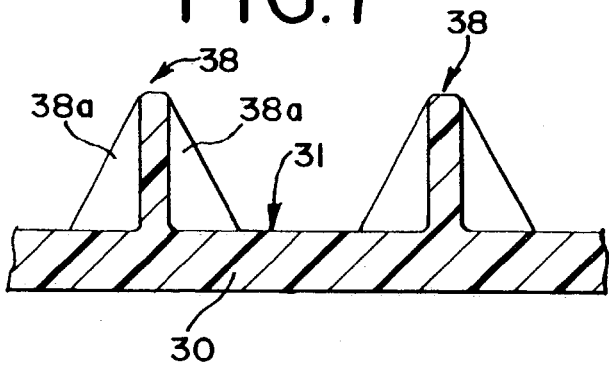
FIG. 7 is a sectional view of the pallet deck and two longitudinal ribs.

It should be noted that while FIG. 7 shows continuous transverse ribs 38 spanning the width of the tray 40, other configurations, such as short, collinear ribs or pillars can be used to strengthen the trays and act as contact points for transmitting the forces applied to the tray.

Finally, with respect to ensuring the underside of the tray couples with the top surface of the deck, the deck can include a perimeter recess running along the edge of the pallet deck for seating the bottom perimeter edge of the tray or top piece abutting the pallet deck. Thus, the ribs underneath the tray can sit directly on the flat top of the pallet deck and no ribs or other upwardly protruding supporting structures are necessary.

Each component above, that being 1) the pallet, 2) the individual trays, and 3) the top piece can be individually molded. The side walls of the trays are made relatively thin with supporting ribs therein to support the load of the trays (with goods thereon) stacked above the tray and to prevent damage from mishandling.

The components can further be marked for guiding users to the correct orientation. Specifically, the front of the pallet, trays and top frame can be marked "FRONT"; arrows (⇨) can be used on the side surface to show the direction of the front of the pallet, trays and top piece.

Finally, the trays have been discussed as being full trays, meaning that their footprint is the same as that for the pallet and top piece. The trays may be made smaller. For example, in some instances, one might not want to handle a full size tray due to the weight or size of it or the articles being palletized. As such half-trays or quarter-trays may be used. Such trays are constructed according to the teachings above, but are smaller. Instead of a single tray, one may employ two half trays that mate with one another and the components above or below them. Each half-tray is half the size of the full tray and together have the same footprint as the top piece and pallet. Thus, the "layer" in the pallet, tray, top piece configuration would be two abutting/adjacent trays as opposed to one tray. In the same manner, each quarter-tray is quarter or quadrant of the size of the full tray and four such trays together have the same footprint as the top piece and pallet. Thus, the "layer" in the pallet, tray, top piece configuration would be four abutting/adjacent trays as opposed to one tray.

While the specific embodiments have been illustrated and described, numerous modifications come to mind without significantly departing from the spirit of the invention and the scope of protection is only limited by the scope of the accompanying Claims.

We claim:

1. A modular tray comprising:

a first end, an opposed second end, a first side, an opposed second side, a top surface, a bottom surface, and an imaginary median disposed between the ends forming two halves of the tray;

a plurality of parallel channels formed in the top surface thereof with each channel being separated by a longitudinal wall with at least two longitudinal walls being higher than other walls for abutting the bottom surface of another tray or a top piece stacked thereon;

a stop formed at an end of a channel at an end of the tray for preventing goods stored in the channel from being moved out of the tray at the end with the stop;

at least one post projecting outwardly or one indentation projecting inwardly from each of the sides and at least one indentation projecting inwardly or one post projecting outwardly from each of the sides, each post cooperating with each indentation, the posts and indentations on one half of the tray being spaced from the median differently than the posts and indentations on the other half of the tray such that when a first tray is stacked upon a second tray, the posts of one tray align and cooperate with the indentations of the other tray only when the first end of the second tray and the first end of the first tray are aligned one above the other and coplanar; and, a first end and an opposed second end overhanging respectively upon the first end and an opposed second end of a tray placed underneath to block the goods from sliding out of the channels in the tray placed underneath.

2. A modular tray comprising:

a first end, an opposed second end, a first side, an opposed second side, a top surface, a bottom surface, and an imaginary median disposed between the ends forming two halves of the tray;

a plurality of parallel channels formed in the top surface thereof with each channel being separated by a longitudinal wall;

a plurality of parallel transverse ribs formed in the bottom surface thereof, the bottom surfaces of the transverse ribs being in direct contact with top surfaces of longitudinal walls formed in a tray placed underneath the tray when the trays are mated; and, at least one post projecting outwardly or one indentation projecting inwardly from each of the sides and at least one indentation projecting inwardly or one post projecting outwardly from each of the sides, each post cooperating with each indentation, the posts and indentations on one half of the tray being spaced from the median differently than the posts and indentations on the other half of the tray such that when a first tray is stacked upon a second tray, the posts of one tray align and cooperate with the indentations of the other tray only when the first end of the second tray and the first end of the first tray are aligned one above the other and coplanar.

* * * * *